US006244907B1

(12) United States Patent
Arnett

(10) Patent No.: US 6,244,907 B1
(45) Date of Patent: Jun. 12, 2001

(54) SELECTABLE COMPATIBILITY ELECTRICAL CONNECTOR ASSEMBLY

(75) Inventor: Jaime Ray Arnett, Fishers, IN (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/630,836

(22) Filed: Aug. 2, 2000

(51) Int. Cl.[7] ..... H01R 33/46
(52) U.S. Cl. ..... 439/676; 439/955
(58) Field of Search ..... 439/344, 676, 439/941, 354, 955

(56) References Cited

U.S. PATENT DOCUMENTS

| | | | | |
|---|---|---|---|---|
| 4,261,633 | | 4/1981 | Abernethy | 339/97 |
| 5,041,018 | | 8/1991 | Arnett | 439/536 |
| 5,096,439 | | 3/1992 | Arnett | 436/536 |
| 5,096,442 | | 3/1992 | Arnett et al. | 439/676 |
| 5,186,647 | | 2/1993 | Denkmann et al. | 439/395 |
| 5,244,402 | * | 9/1993 | Pasterchick, Jr. et al. | 439/676 |
| 5,302,140 | | 4/1994 | Arnett | 439/557 |
| 5,647,767 | | 7/1997 | Scheer et al. | 439/620 |
| 6,042,427 | | 3/2000 | Adriaenssens et al. | 439/676 |
| 6,059,578 | | 5/2000 | Arnett | 439/43 |
| 6,074,256 | | 6/2000 | Arnett | 439/676 |

* cited by examiner

*Primary Examiner*—Renee Luebke
*Assistant Examiner*—Felix O. Figueroa

(57) ABSTRACT

A selectable compatibility electrical connector assembly has a high performance plug for mating with the jack to form a high performance electrical connection or to provide switching among various circuit elements to change the transmission characteristics of the assembly. The jack is adapted to receive low performance plugs and has a plug stop therein for limiting the depth of insertion of the low performance plug into the jack. The plug of the invention has an elongated notch in its front end which is designed to clear the plug stop for insertion of the plug to a depth greater than that of the low performance plug. The jack has first and second longitudinally offset latching stubs for latching both the low performance and the high performance plug at their proper insertion depth. An embodiment of the jack has a reciprocating switch assembly adapted to be actuated by the high performance plug when inserted to its proper depth in the jack.

23 Claims, 7 Drawing Sheets

SELECTABLE COMPATIBILITY ELECTRICAL CONNECTOR ASSEMBLY

RELATED APPLICATIONS

This application is related to, and deals with subject matter similar to that of U.S. Pat. Nos. 6,139,343; 6,168,472; and 6,056,568, of Jaime R. Arnett, filed Jan. 25, 1999, and U.S. Pat. No. 6,074,256 of Arnett; filed Apr. 15, 1999 and issued Jun. 13, 2000, the disclosures of which are incorporated by reference herein.

FIELD OF THE INVENTION

The present invention relates generally to electrical connectors and, more particularly, to a modular connector of the type used in telecommunications equipment.

BACKGROUND OF THE INVENTION

Telecommunication equipment has benefited from the design of electrical plugs and jacks that provide easy connect/disconnect capability between electrical circuits within the telecommunications equipment and, for example, local network wiring. Such plugs and jacks are particularly popular in association with telephone sets, where they were first used, and, more recently, in association with a large variety of peripheral equipment that is connected to telephone lines. The modular plugs and jacks in use today have been standardized insofar as their performance specifications are concerned and also insofar as certain critical dimensions and structural features are concerned. The use of these devices has become so widespread that new houses and other buildings are prewired with jacks located throughout the various rooms as well as other strategic locations, to accommodate the communication equipment. Where large numbers of such connections are needed, it is typical practice to route the wires to a central location, such as a communication closet where, typically, the jacks are mounted on patch panels. Such an arrangement is shown, for example, in U.S. Pat. No. 5,096,439 of J. R. Arnett. In most installations, it is desirable that the jack be compact, and there have been numerous jacks designed to achieve this goal. In U.S. Pat. No. 5,096,442 of J. R. Arnett there is shown one such compact jack and plug arrangement which, together, constitute a compact electrical connector. The compact electrical connector shown in that patent includes a metallic lead frame mounted to a spring block. The lead frames comprise a number of flat elongated conductors, each terminating in a spring contact at one end and an insulation displacement connector at the other end. The insulation displacement connectors are folded around opposite side walls of the spring block and achieve compactness, and the spring contacts are folded around the front surface of the spring block for insertion into a jack frame. The front surface of the spring block includes a tongue-like projection which fits into one end of the jack frame and interlocks therewith. With the ever increasing numbers of peripheral equipment, and with concomitant increases in operating frequencies, such as required in digital data transmission, connector assemblies such as shown in the aforementioned Arnett '442 patent, while enjoying a large amount of commercial success, do not function well in the higher frequency ranges. The use of such plugs and jacks is impaired by crosstalk within the components, especially in the plug, and as frequencies increase, so does the effect of crosstalk. Numerous arrangements have been proposed for reducing the effects of crosstalk overall by connectors having a minimum of crosstalk, or by connectors which add compensating crosstalk to the overall circuit, such as adding capacitance to the jack to nullify or compensate for the crosstalk in the plug. In U.S. Pat. No. 5,186,647 of W. J. Denkmann et al., there is shown an electrical connector for conducting high frequency signals in which the input and output terminals are interconnected by a pair of metallic lead frames mounted on a dielectric spring block. The lead frames, which are substantially identical to each other each comprises several flat elongated conductors, terminating in spring contacts at one end and insulation displacement connectors at the other end. The conductors are generally parallel and close to each other, but three conductors of one frame are arranged to overlap three conductors of the other frame in a crossover region. As a result, the crosstalk between the several conductors is reduced, due to the reversal in polarities caused by the crossovers.

Nevertheless, for a wide range of applications, an electrical connector having even less crosstalk would be desirable. Also, desirably, a connector capable of making other circuit connections for uses other than, or in addition to, crosstalk manipulation, would impart a degree of versatility to the connector not heretofore realized. In particular, the rate of data flow, which is continually being increased in the art today, causes the wiring parts to become, in effect, antennae which both broadcast and receive electromagnetic radiation, thereby, in effect, coupling different pairs of wires together, (crosstalk), thereby degrading the signal-to-noise ratio, and producing an increased error rate. Connectors which, in effect, nullify or at least reduce overall crosstalk, and yet which are usable over wide frequency ranges and which are capable of making other circuit connections, are desiderata to which the present invention is addressed. In order for wide frequency usage to be possible, it is desirable that at least some of the components of the connector be compatible with components of connectors in both the low and the high performance categories.

The aforementioned related applications and patent of Jaime R. Arnett, the present inventor, the disclosures of which are incorporated herein by reference, deal with selectable compatibility connectors, plugs, and jacks wherein a connector assembly of a plug and a jack, which are designed to operate together as a high performance connector, but which automatically introduce capacitance into the connection circuit when used as a component or components of a low performance connector to alter the crosstalk performance and transmission loss characteristic thereof. The terms "high" and "low" are terms of art and relate to several connector parameters, chief among which is crosstalk, as will be discussed more fully hereinafter. It is desirable, for optimum performance, that the plug and the jack operate together in the desired frequency range. Thus a low performance jack should operate with a low performance plug, and a high performance jack should operate with a high performance plug.

In greater detail, the plug shown in those applications has mounted therein a printed wiring board which is movable in longitudinal translation in a pair of guiding slots. On one surface of the wiring board, or PWB, are a plurality of spaced capacitance contact pads, the number being dependent upon the number of leads to which it is desired to add capacitance. The wire leads in the plug which, as in normal practice, wrap around the nose of the plug, have contact portions which bear against the surface of the PWB, and against the capacitance pads of the PWB in a second position thereof, or simply against the non-conducting surface of the board in a first position thereof. The plug further includes a spring member which bears against the end of the PWB remote from the plug nose, and functions to bias the PWB toward the first, non-capacitance engaging position. Actuator means, such as stand-offs from the PWB, function to engage a portion of the jack where the jack is a low performance component when the plug is inserted therein, thus moving the PWB to the capacitance engaging position to introduce capacitance into the circuit for crosstalk compensation and to alter the transmission loss characteristic in the low performance mode. Thus the high performance plug of the invention can be used with a low performance jack.

The second component of the high performance connector of these applications is a jack which has mounted therein a PWB which is movable in longitudinal translation in a pair of guiding slots. As is the case with the plug of the invention, the PWB has on one surface thereof a plurality of closely spaced capacitance contact pads, the number being dependent upon the number of leads to which it is desired to add capacitance. The wire leads in the jack have contact portions which bear against the surface of the PWB and, in a second position, against the capacitance pads thereon, or against a non-conducting portion of the PWB in a first position. The PWB, which as pointed out before, is movable relative to the jack, and more particularly, to the wire leads therein, is biased by a spring member within the jack housing to the first or non-capacitance introducing position which is the desired position for the high performance jack. The PWB has spaced actuator stand-offs mounted thereon which, as will be explained hereinafter, are pushed by the nose portion of a low performance plug to move the PWB to the second position, thereby introducing capacitance into the connector circuit. The jack is provided with first and second spaced slots which receive the stand-offs of the high performance plug of the invention, thereby preventing them from actuating the PWB in the plug. By the same token, the plug has recesses in the sides of the housing thereof which provide clearance for the stand-offs on the PWB of the jack, thereby preventing the high performance plug of the invention from actuating the PWB of the jack.

In U.S. Pat. No. 6,074,256 of Arnett, there is shown a connector assembly in which a stationary PWB (printed wiring board) mounted in the plug has a plurality of capacitance contact pads thereon and the wire leads of the plug have contact portions which are movable into contact with the pads by means of movable buttons, for example. When the plug is inserted into a low performance jack, the buttons, or other means, force the leads in the plug into contact with the capacitance pads for a low performance connector configuration. When the plug is inserted into a high performance jack, the leads remain in their non-contacting orientation and form, with the jack, a high performance connection.

The connector arrangement of the Arnett application is primarily aimed at crosstalk compensation. However, and as pointed out in that application, the arrangement can be used to introduce or remove various circuit elements performing other functions than, or in addition to, crosstalk compensation. In the rapidly growing high performance connector usage, it is desirable that the connectors, i.e., jack and plug, be adaptable to other uses such as switching various circuits or circuit elements into and out of the connector circuit, which still maintaining compatibility of both plug and jack with low performance connector elements.

The plug and jack of the foregoing applications are characterized by each having a printed wiring board that is movable in translation, as discussed. It is also possible, if not in the interests of cost, desirable, to have similar selectable compatibility electrical connector assemblies in which the components, i.e., the plug and jack, having stationary printed wiring boards or other circuitry, and it is to such arrangements that the present invention is directed.

SUMMARY OF THE INVENTION

The connector assembly of the present invention, comprising a jack and a plug, is characterized by selectable compatibility and is designed to introduce automatically connection of at least some of the conductive leads within the connector to other circuit elements, including switching elements for example, when the high performance plug of the connector is introduced into the high performance jack thereof On the other hand, both jack and plug are compatible with a standard low performance plug or standard low performance jack respectively.

In greater detail, the jack of the invention has an apertured front face and a substantially hollow interior, in common with prior art jacks. The plug of the invention has a front end insertable into the apertured jack, and a cantilevered latching arm for latching the plug within the jack, wherein conductors in the front end of the plug make contact with spring contact conductors in the jack, as in the prior art. In contrast to a standard low performance jack, which has a pair of latching stubs in the aperture at the front face, the latching stubs of the jack of the invention are longitudinally offset from one another, with a first stub being located at the front face of an extension on the jack, and a second stub spaced laterally and longitudinally offset into the jack interior from the first stub. Also, within the interior of the jack are first and second plug stops which are also spaced laterally and longitudinally offset from one another. The spacing between the first stub and first plug stop is substantially equal to the spacing between the second stub and second plug stop.

A standard low performance plug has latching members on either side of the latching arm, for engaging at least one of the latching stubs at a first penetration depth, however, the plug of the invention has a latching member on only one side of the arm, and the arm itself has a clearance cutaway on the other side thereof. When the plug of the invention is inserted into the jack of the invention, the cutaway area clears the first latching stub and insertion can continue until the latching member engages the second latching stub at a second penetration depth. The front end of the plug has a clearance notch which allows the plug to pass the first plug stop, and a second, shorter notch which engages the second plug stop. On the other hand, when a low performance plug is inserted into the jack, it engages the first latching stub and first plug stop and thus is prevented from moving as far into the jack as the plug of the invention, but far enough to engage the spring contacts.

Within the interior of the jack are the spring contacts which are engageable by the front or nose of the plug, either low performance or high performance. However, the high performance plug of the invention moves farther into the jack and engages and displaces the spring contacts, moving them into engagement with circuit elements, such as a PWB or capacitance pads contained within the jack, or into contact with leads going to circuit elements exterior of the jack.

In a second embodiment of the invention, the spring contacts are normally in contact with circuit elements, such as capacitance pads, and the jack of the invention is thus configured to function as a low performance jack when a low performance plug, which engages but does not displace the spring contacts, is inserted therein. However, when a high performance plug is inserted, it penetrates deeper into the jack, thereby displacing the spring contacts and moving them out of contact with the circuit elements, e.g., capacitance pads, and into contact with other circuit elements, as explained in the foregoing. Thus the jack automatically changes from a low performance jack reception of low performance plugs to a high performance jack when the high performance plug of the invention is inserted therein and latched thereto.

In another embodiment of the invention, the plug of the invention engages a plunger or switch button, thereby activating a switch to introduce other circuit elements into circuit with the connector.

The numerous principles and features of the present invention, as well as the structural details thereof, will be more readily understood from the following detailed description, read in conjunction with the accompanying drawings.

DETAILED DESCRIPTION

Figure 1:
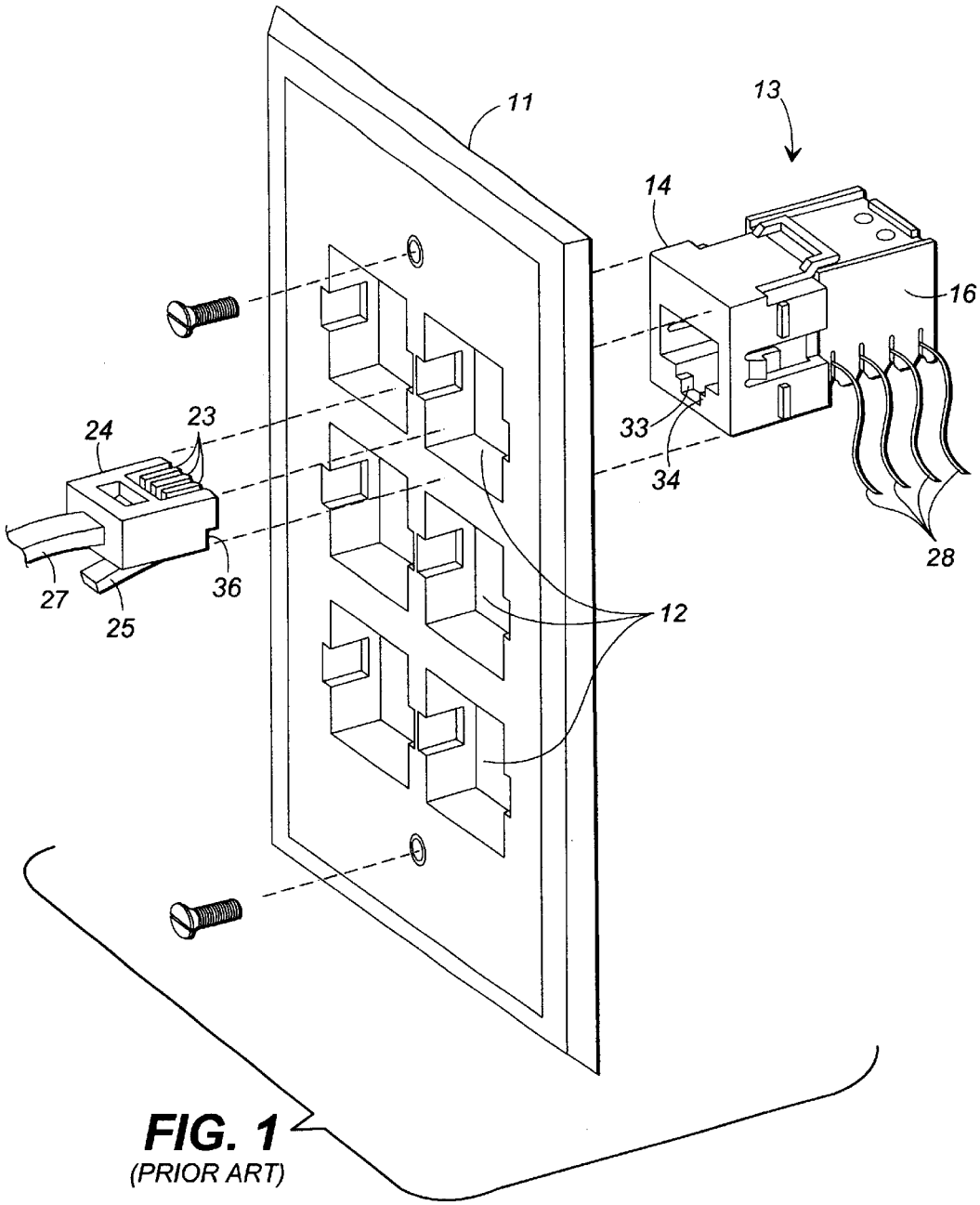
FIG. 1 (PRIOR ART)
FIG. 1 is an exploded perspective view of a prior art connector assembly.
Figure 1A:
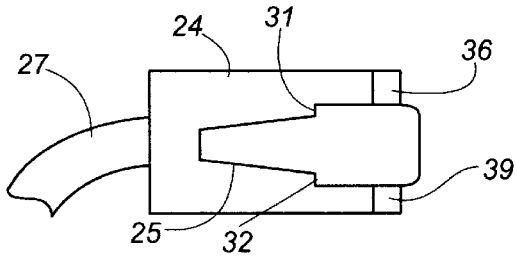
FIG. 1a (PRIOR ART)
FIG. 1*a* is a plan view of the connector plug of the assembly of FIG. 1.
Figure 2:
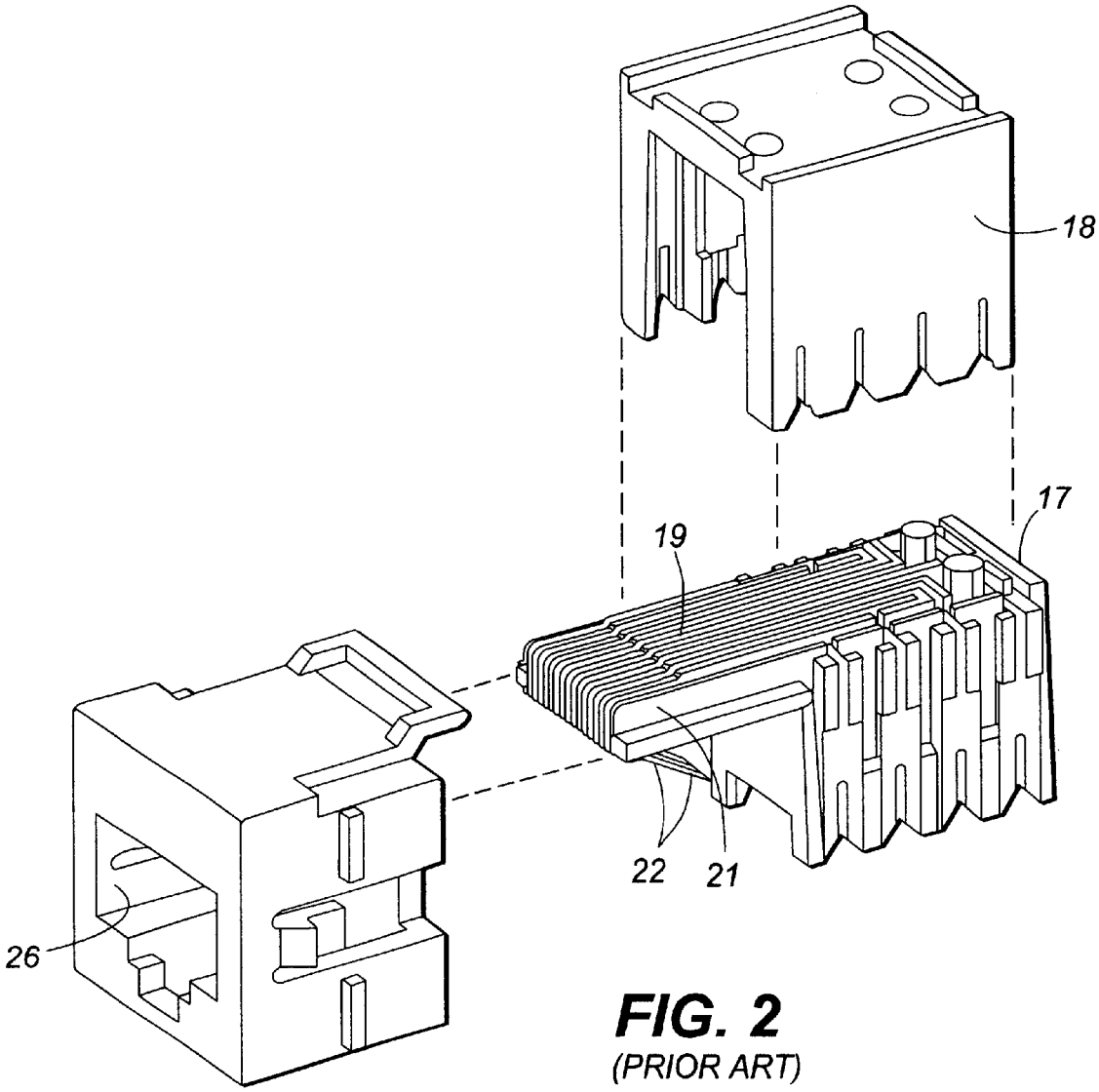
FIG. 2 (PRIOR ART)
FIG. 2 is an exploded perspective view of the prior art connector jack of the assembly of FIG. 1.
Figure 3:
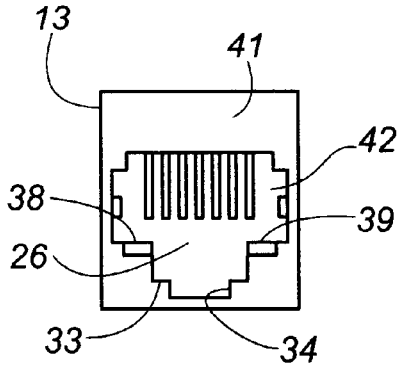
FIG. 3 (PRIOR ART)
FIG. 3 is a front elevation view of the jack frame of FIG. 2.

FIG. 1 depicts a prior art wall plate 11 such as is shown in U.S. Pat. No. 5,096,442 of Arnett, which has openings 12 therein for receiving up to six modular jacks 13. As shown in the Arnett patent, jack 13 comprises a jack frame 14 and a connector 16 of insulating material which, together, constitute modular jack 13. As can be seen in FIG. 2, connector 16 comprises a spring block member 17 and a cover member 18 both of suitable insulating material and which is insertable into a rear opening of jack frame 14. Spring block 17 has a wire frame 19 mounted thereon, the leads of which curve around the nose 21 of the spring block 17 and depend at an angle therefrom to form a plurality of spring contacts 22, which mate with contact members 23 in the plug 24, also of insulating material, when it is inserted into the front opening 26 of jack frame 14 and locked by means of trigger or latching arm 25. Cantilevered latching arm 25 is shown in FIG. 1*a*, which is a plan view of plug 24, inverted relative to FIG. 1. In the discussion to follow, in order to avoid confusion, the surface upon which the latching arm is mounted shall be referred to as the top surface, although in actual practice it is usually the bottom surface of the plug. Arm 25 has first and second latching shoulders 31 and 32, which, when plug 24 is inserted in jack 13, engage first and second latching stubs 33 and 34, thereby holding plug 24 within jack 23. The front end of plug 24 has first and second notches 36 and 37 which form shoulders for engaging plug stops within the jack frame 14 (not shown in FIGS. 1 and 2) to limit forward travel of the plug. The contact members 23 are each connected to an individual wire in cable 27, and the spring contacts 22 are each connected to an individual wire 28 which may be part of a cable, not shown, or which may lead to individual apparatus, not shown. The plug 24 and the jack 13 may form connections for a number of wires such as, for example, four or eight, depending upon the particular application. Wire frame 19 is shown in FIG. 2 as having eight wires, and, hence, eight spring contacts 22, while plug 24 is shown, for convenience, as having only four contact members. It is to be understood that FIG. 2 does not depict a specific connector hook-up, but is intended to illustrate the relationship of the various parts or components of the connector module. FIG. 3 is a front elevation view of the prior art jack 13, showing the opening 26, latching stubs 33 and 34 and plug stops 38 and 39, which, as will be apparent hereinafter, are rearwardly spaced from the front face 41 of jack 13. A slotted wall 42 serves to align and hold the spring contacts 22. The shoulders of notches 36 and 37 on plug 24 are adapted to engage stops 38 and 39 to prevent the plug 24 from penetrating too far into jack 13. The arrangement of FIGS. 1 and 2 has been modified in numerous ways, as pointed out hereinbefore, in efforts to improve, for example, the near end crosstalk (NEXT) performance, achieve greater compactness, or to facilitate the operation of connection/disconnection in usage. In all such cases, the actual connect/disconnect operation of the apparatus is basically the same, even where the plugs or jacks have been modified extensively for whatever reason. In other words, the industry standards have to be met. The present invention is a connect system which is intended to extend the performance range of operation but which complies with industry standards to the extent that the plug and jack of the invention are compatible with existing plugs and jacks, and which, automatically introduce capacitance or other circuit elements into the circuitry upon sensing that either the plug or the jack is being used with a pre-existing prior art jack or plug. Thus, the plug and jack of the present invention exhibit "backward compatibility."

"Backward compatibility" is, at present, being explored in the prior art, and proposals exist for achieving it. In a monograph entitled "Connectors With Accessed Quality For Use In D.C., Low Frequency Analogue, And In Digital High Speed Data "Applications, " IEC 61076-X-Y, issued by the International Electrotechnical Commission, there are shown several suggested arrangements for achieving compatibility among plus and jacks. Most of the jacks and plugs therein disclosed rely upon switching, either manually or automatically, between two different wiring schemes, whereas the present invention, as will be apparent hereinafter, relies upon the introduction or removal of capacitance or other current elements from the component or components of the connector system, or, in one embodiment, the actuation of a switch to alter the circuit characteristics.

Figure 4A:
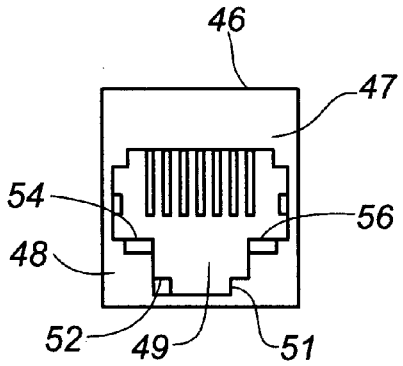
FIG. 4*a* is a front elevation view of the jack frame of the present invention.
Figure 4B:
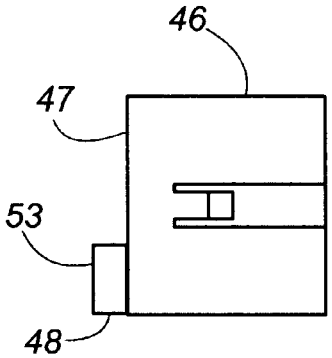
FIG. 4*b* is a side elevation view of the jack frame of FIG. 4*a;*

FIGS. 4*a* and 4*b* are front and side elevation views respectively of the jack frame 46 of the present invention. As will be apparent hereinafter, the principles of the invention are embodied in modifications to the plug 24, jack frame 14 and connector 16, which together make up jack 13. Jack frame 46, which is a substantially hollow body, has a face 47 from which an extension 48 protrudes, and an opening 49. As will be more clearly seen and discussed hereinafter, a first latching stub 51 is substantially flush with the front face 53 of extension 48, and a second latching stub 52 is rearwardly spaced from stub 51. Similarly, first and second plug stops 54 and 56 are longitudinally spaced from each other, although the spacings are not clearly shown in FIGS. 4*a* and 4*b*.

Figure 5:
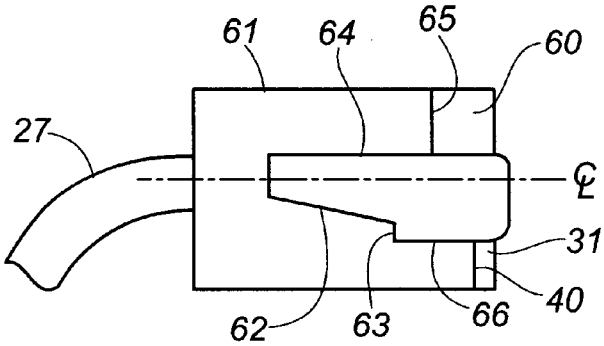
FIG. 5 is a plan view of the connector plug of the present invention.

FIG. 5 is an inverted plan view of the plug 61 of the present invention in which it can be seen that the cantilevered latching arm 62 only has one latching shoulder 63 which, as will be discussed more fully hereinafter, is adapted to latch to latching stub 52 in jack frame 46. The other side 64 of arm 62 is straight, i.e. without latching means, and extends substantially parallel to the plug centerline. Also, that portion of the arm 62 from the centerline to the edge of side 64 is narrower than from the centerline to the other edge 66. The narrower portion allows arm 62 to pass into aperture 49 of jack frame 46 without engaging latch stub 51. This action will be clearly understood from FIGS. 6, 7, 8, and 9 and the discussion thereof. Plug 61 has an elongated notch 60 forming a shoulder 65 adapted to engage plug stop 56 to limit rearward movement of plug 61. Plug 61 also has a standard notch 37 forming a shoulder 40 for engagement with plug stop 54 in jack frame 46. Both jack 13 and jack frame 46 have rearward openings 70.

FIGS. 6 through 9 are diagrams of, respectively, a prior art jack 13 mated with a prior art plug 24, a prior art jack 13 mated with the plug 61 of the invention, the jack frame 46 of the invention mated with a prior art plug 24; and the jack frame 46 of the invention mated with the plug 61 of the invention. It is to be understood that FIGS. 6 through 9 are intended to show, diagrammatically, the actions of the latching stubs and plug stops in each of the four arrangements, and are not intended to be precise depictions of the several components.

Figure 6:
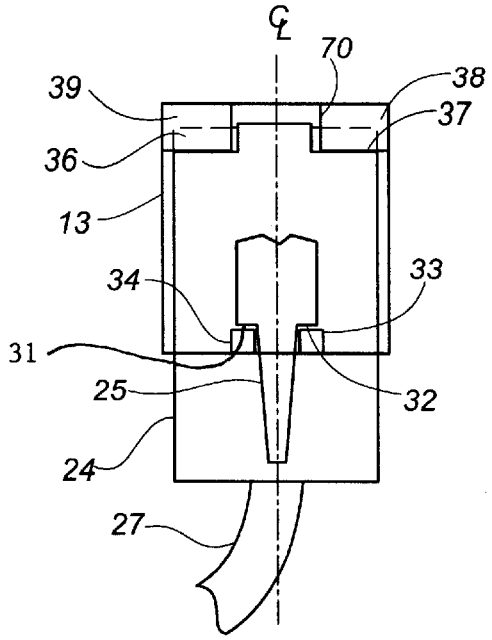
FIG. 6 (PRIOR ART)
FIG. 6 is a diagrammatic plan view of a prior art connector assembly.

FIG. 6 diagrams the relationship between prior art jack 13 and prior art plug 24, which is inserted therein. It can be seen that when plug 24 is fully inserted, the plug stops bear against the shoulders formed by notches 36 and 37 to prevent further rearward movement of plug 24. At the same time, latching shoulders 31 and 32 engage latching stubs 33 and 34 to prevent the plug from being pulled out of jack 13. Thus, both forward and rearward movement of plug 24 are effectively prevented.

Figure 7:
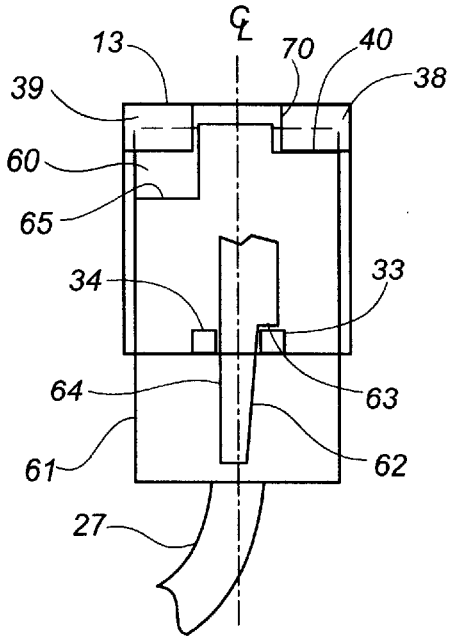
FIG. 7 is a diagrammatic plan view of the plug of the present invention mated to a prior art jack frame.

The diagram of FIG. 7 illustrates the compatibility of the new plug 61 of the invention with a prior art jack 13, thereby creating a low performance connection. When the plug 61 is inserted into jack 13, its rearward movement is arrested, and further rearward movement prevented, by shoulder 40 engaging plug stop 38. At the same time, latching shoulder 63 latches to latching stub 33 to prevent the plug 61 from being pulled out of the jack 13. Thus plug 61 functions in the same manner as plug 24 in FIG. 6 as a low performance plug.

Figure 8:
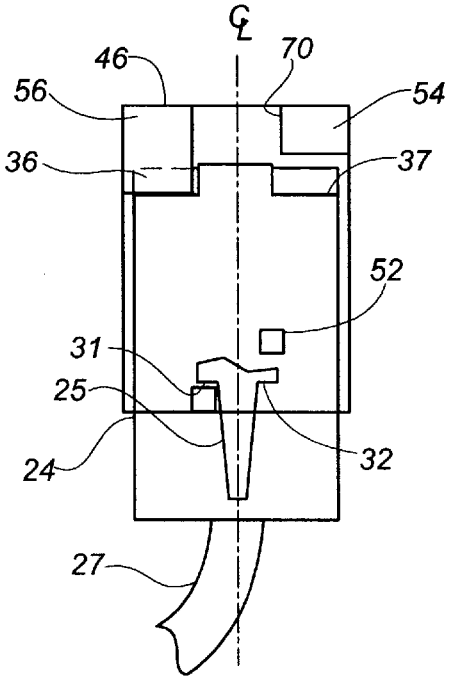
FIG. 8 is a diagrammatic plan view of a prior art connector plug mated to the jack frame of the present invention.

FIG. 8 depicts a prior art generally low performance plug 24 inserted into the jack frame 46 of the invention. It can be seen that rearward movement is limited by the shoulder of notch 36 engaging elongated plug stop member 56, and reverse movement is prevented by latching shoulder 31 engaging latching stub 34. As a consequence, plug 24 does not penetrate all the way into the jack frame 46, but, as will be seen clearly hereinafter, it does penetrate sufficiently into jack frame 46 to make the desired contact with the contact springs 22 to create a low performance connection.

Figure 9:
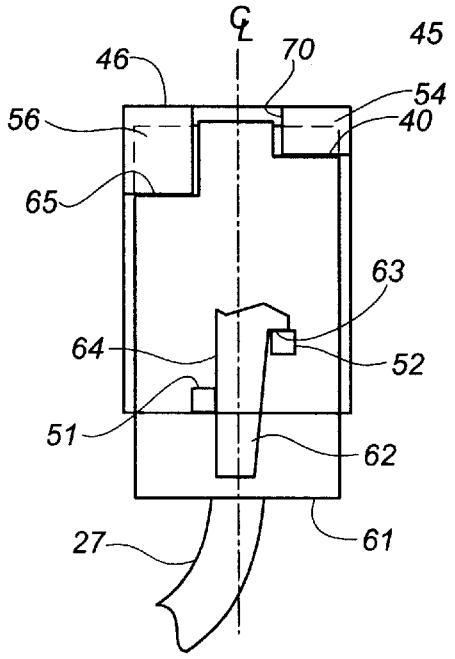
FIG. 9 is a diagrammatic plan view of the connector plug of the invention mated to the jack frame of the invention.

The connector 45 of the invention, comprising both jack frame 46 and plug 61 inserted therein is shown in FIG. 9. Plug 61 is insertable into jack frame 46 until shoulder 65 engages plug stop 56 and shoulder 40 engages plug stop 54. At the same time, or, rather, in the position, latching shoulder 63 latches to latch stub 52. The cutaway straight side 64 of latching arm 62 does not, as shown, engage latching stub 51. If side 64 had a latching shoulder corresponding to shoulder 63, when that shoulder passed over stub 51 an installer might be misled into thinking the connection was complete, even though the plug 61 had not been inserted sufficiently far into jack frame 46 for plug stops 54 and 56 to engage plug 61. Thus, with the elimination of such latching shoulder, such as erroneous indication is prevented. As can be seen in FIG. 9, plug 61 travels farther into jack frame 46 than does prior art plug 24, as seen in FIG. 8. As will be apparent hereinafter, this additional travel alters the circuitry of jack frame 46 to produce a high performance connection, or to achieve other switching or circuitry changes.

Figure 10:
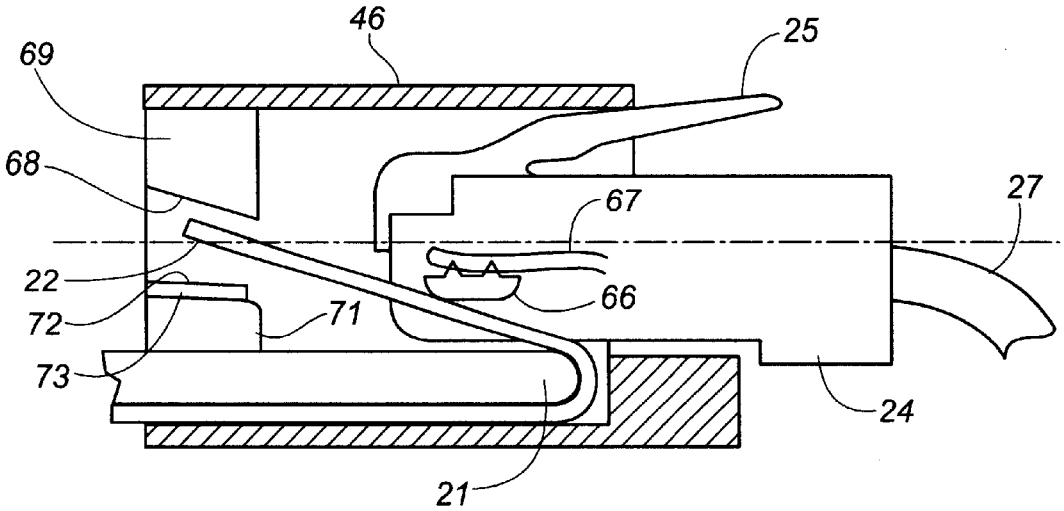
FIG. 10 is a diagrammatic elevation view partially in cross-section of a prior art plug mated to the jack frame of the invention.
Figure 11:
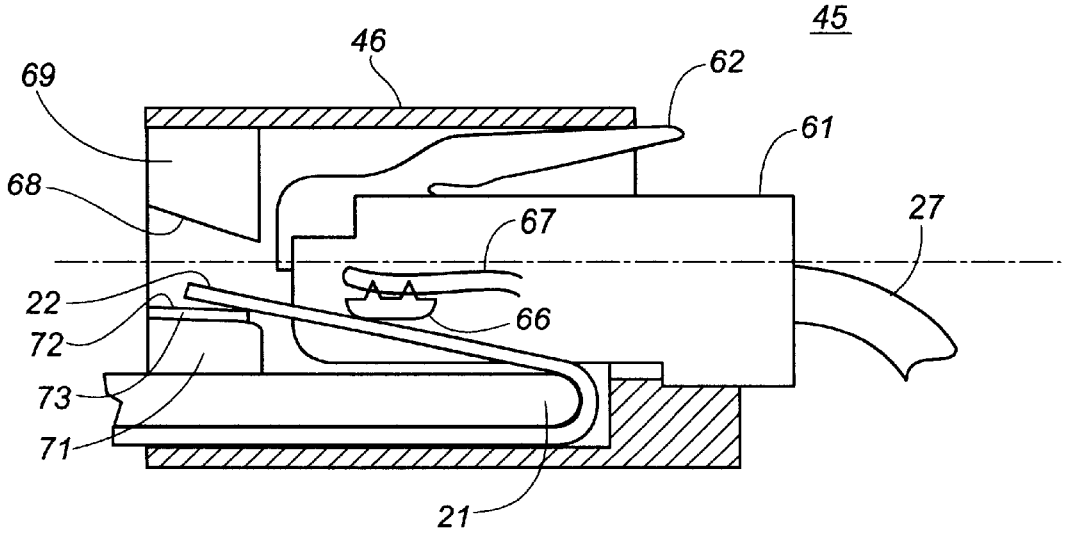
FIG. 11 is a diagrammatic elevation view partially in cross-section of the plug of the invention mated to the jack frame of the invention.
Figure 12:
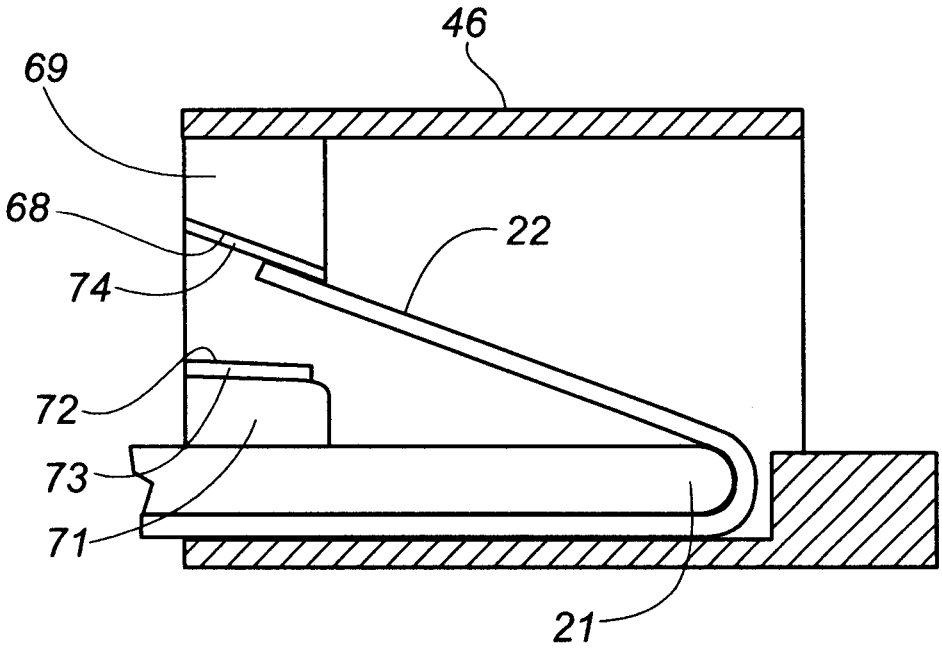
FIG. 12 is a diagrammatic elevation view of a second embodiment of the jack frame of the invention.
Figure 13:
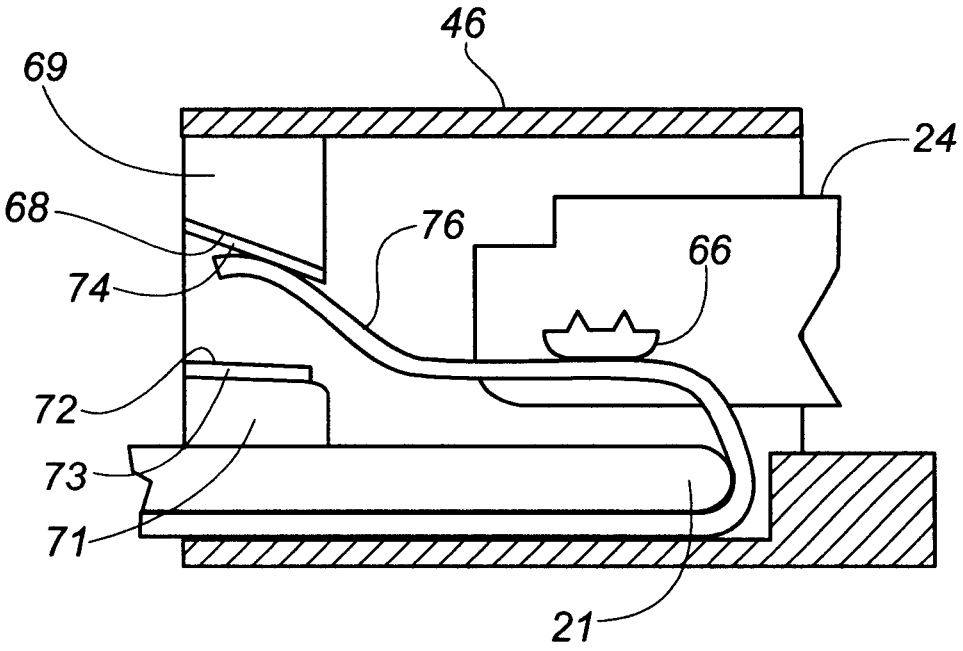
FIG. 13 is a diagrammatic elevation view in partial cross-section of the jack frame of FIG. 12 as modified.

FIGS. 10, 11, and 12 are partially diagrammatic, partially cross section views in elevation FIGS. 10 and 11 of which correspond, respectively, to the arrangements shown in FIGS. 8 and 9. From FIGS. 8 and 9 it can be seen that plug 61 penetrates farther into jack frame 46 than does prior art, or low performance, plug 24, and FIGS. 10 and 11 illustrate the effect of these differences in penetration. In FIG. 10 it can be seen that plug 24 when fully inserted, bears against spring contacts or wires 22, by means of standard blade 66, to complete electrical connection between wires 67 of cable 27, and to move contact 22 away from a sloped bearing surface 68 on an upper projecting block 69. A lower projecting block 71 projects upward from the floor of jack frame 46, as viewed in FIG. 10 and has an array of capacitance pads 72 on, for example, a printed wiring board 73. The terms "upper" and "lower" and "upward" are not intended to be limiting, but simply conform to the views shown as a matter of convenience. Although capacitance pads 72 (only one of which is shown) are instrumental in altering the electrical characteristics of the connector 45 of the invention, it is to be understood that PWB 73 may have other, different, circuitry and components, depending on the particular function assigned to connector 45. In addition, it is to be understood that PWB 73 may be replaced by individual circuit elements on the top surface of projection 71. Further, where connections to elements external to the connector 45 are made, the leads from the circuitry within connector 45 are not shown, to avoid confusion. Such leads are well within the purview of those skilled in the art, and may take any of a number of forms or configurations.

As can be seen in FIG. 11, the greater depth of penetration of plug 61 into jack frame 46, as was discussed with respect to FIG. 9, causes spring wires 22 to be pushed down to make contact with capacitance pads 72 or PWB 73 on lower projection 71. Pads 72 or the circuitry on PWB 73, when contacted by spring wires 22, alter the electrical characteristics of the connector 45 to produce a high performance plug, for example. As pointed out hereinbefore, the connector 45 is quite versatile in that it can be adapted to other uses besides the reduction of crosstalk. FIG. 12 shows one such adaptation in a second embodiment of the invention wherein sloped surface 68 has a circuit element or elements 74 thereon. Element 74 may comprise individual circuit elements such as capacitance pads or it may comprise a printed wiring board having capacitance pads, resistors, or the circuitry thereon. The jack frame 46 of FIG. 12, as shown, with spring wires or connectors bearing against element 74, may function as a low performance jack, for example. When a low performance, i.e., prior art plug is inserted therein, blade 66 contacts specially configured spring conductor 76, which is in contact with circuit element 74, sufficient to establish electrical continuity, but not sufficient to remove spring conductor 76 of electrical contact with element 74. Thus, jack frame 46 functions as a low performance jack. However, when the high performance plug 61 of the invention is inserted in jack frame 46, the action shown in FIG. 11 takes place and jack frame 46 switches to a high performance jack frame configuration, thereby making a high performance connector. FIGS. 10 through 13 also illustrate the versatility available utilizing the principles of the invention. Elements 73 through 74 may have any of a number of possible circuit arrangements, and may be used singly or collectively, i.e. both elements 74 and 73 may be present, or only one or the other. The plug 61 and jack frame 46 can be regarded as an automatic switching arrangement which produces a wide range of electrical characteristics.

Figure 14:
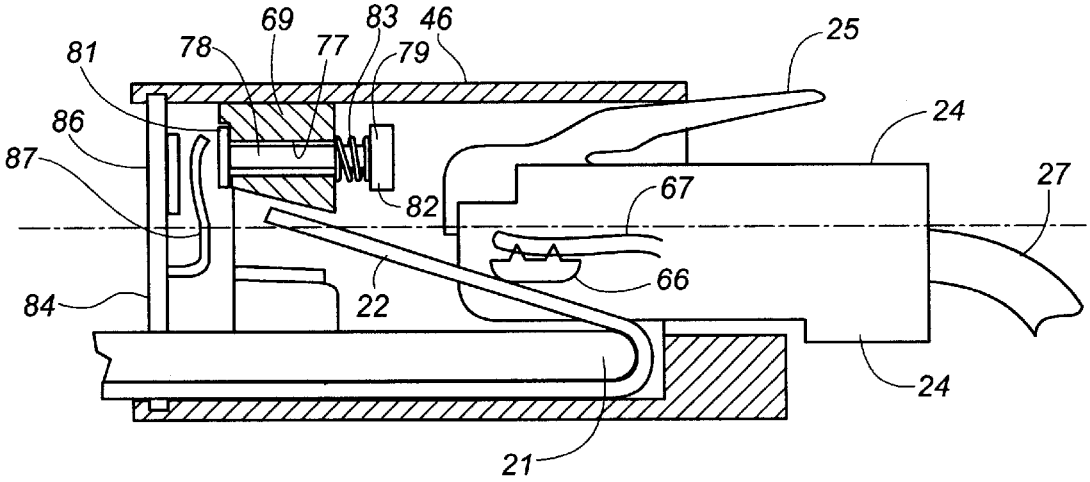
FIG. 14 is a diagrammatic elevation view partially in cross-section of another embodiment of the jack frame of the invention with a prior art plug inserted therein.
Figure 15:
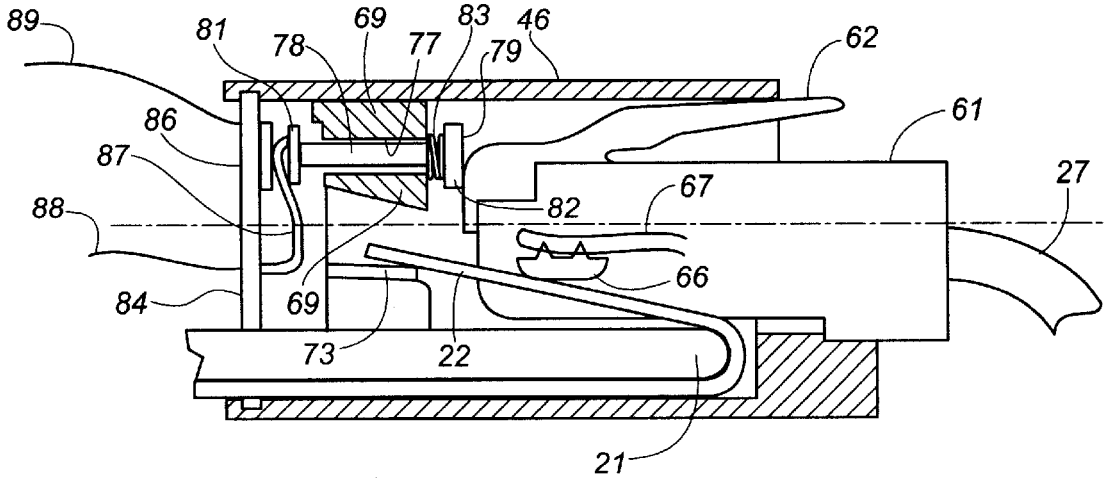
FIG. 15 is a diagrammatic elevation view partially in cross-section of the jack frame of FIG. 14 with the plug of the invention inserted therein.

FIGS. 14 and 15 illustrate an alternative switching arrangement wherein projection 69 of jack frame 46 has a bore 77 which contains the shaft 78 of a switch actuating plunger 79 having headed ends 81 and 82 and a biasing spring 83 for maintaining the plunger in the position shown in FIG. 14. Mounted in the rear of jack frame 46 by suitable means is a circuit board or PWB 84 having circuit elements 86, e.g. capacitance pads, thereon. A spring contact member 87 extends into the space between head 81 and board 84, as shown. When, as is shown in FIG. 14, a lower performance plug 24, is inserted into jack frame 46, it depresses spring contact or conductor 22 in the same manner as shown in FIG. 10. However, plug 24 does not penetrate into jack housing 46, see FIGS. 8 and 10, far enough to contact the headed end 82 of switching plunger 79, and the switch remains unactuated. When, on the other hand, the plug 61 of the invention is inserted into jack frame 46, the nose portion of latching arm 61 bears against headed end 82 of plunger 79 and forces it toward the rear, compressing spring 83. Headed end 81 bears against spring contact 87 and forces it into contact with circuit element 86. Connecting leads 88 and 89 are intended to represent, schematically, a means by which the switch comprising contact member 87 and circuit elements 86 can be connected to external circuitry. Although not shown, spring contacts 22 and PWB 73 can be connected to the external circuitry also, as was pointed out hereinbefore. Instead of spring 83, spring contact 87 can be made to bear against headed end 81 to supply the biasing force. Thus when the nose portion of latching area 62 presses against headed end 82, the biasing force of spring contact 87 is overcome and plunger 79 forces contact 87 into contact with circuit element 86.

The connector 45 of the invention as disclosed in the foregoing, has a broad range of possible applications as a result of its versatility. There are, basically, no moving parts, except the plug 61 (or plug 24) relative to the jack frame 46, and the spring wires 22, except for the switch arrangement of FIGS. 14 and 15. Thus the connector of the invention is both simple and economically manufactured.

In conclusion, it should be noted that it will be obvious to those skilled in the art that many variations and modifications can be made to the preferred embodiment without substantial departure from the principles and scope of the present invention. All such variations and modifications are intended to be included herein as within the scope of the present invention, as set forth hereinafter.

What is claimed is:

1. A selectable compatibility electrical connector assembly comprising:

a first member comprising a jack having a jack frame and a second member comprising a plug having a nose section and adapted to mate with said jack, said connector having a first transmission characteristic when said first and second members are mated;

said second member having a longitudinal centerline and a latching arm thereon having a latching shoulder transversely spaced from the centerline;

said first member having a longitudinal centerline and an opening extending therein for receiving said second member, and front and rear portions, a first latching stub in said first member at said front transversely spaced from the centerline;

a second latching stub in said first member longitudinally spaced from said first stub and transversely spaced therefrom on the opposite side of the centerline; and the transverse spacing of said latching shoulder and said second latching stub being such as to cause said second latching stub to engage said latching shoulder to latch said second member within said first member at a first longitudinal position therein.

2. The connector assembly as claimed in claim 1 wherein said first member has a first plug stop adjacent said rear portion on one side of the centerline of said first member and extending toward said front, and a second plug stop adjacent said rear portion on the opposite side of said centerline from said first stop and extending toward said front portion;

said first plug stop extending a greater distance toward said front portion than said second plug stop.

3. The connector assembly as claimed in claim 2 wherein said first plug stop is on the opposite side of the centerline of said first member from said second latching stub.

4. The connector assembly as claimed in claim 3 wherein said second member has first and second notches in said nose portion on opposite sides of the centerline of said first member.

5. The connector assembly as claimed in claim 4 wherein said first and second notches form shoulders adapted to bear against said first and second plug stops.

6. The connector assembly as claimed in claim 5 wherein said first notch extends farther, longitudinally in said second member than said second notch.

7. A communication plug for interconnecting a cable to a jack, the jack having a plurality of spring connectors in a sloped array and plug stop members and latching stubs therein, said communication plug comprising:

an elongated body having a centerline and a front nose portion having a plurality of electrical connectors therein for contacting one or more of the spring connectors in the jack when said plug is inserted therein;

a first clearance notch extending from said nose portion along a portion of the length of said elongated body at one side of said centerline;

a second clearance notch extending from said nose portion along a portion of the length of said elongated body on the other side of said centerline from said first notch;

said first notch extending farther along said body than said second notch; and a latching arm extending from one surface of said body, said latching arm having a latching shoulder thereon for engaging a latching stub in the jack.

8. A communication plug as claimed in claim 7 wherein said latching shoulder is on the opposite side of said centerline from said first clearance notch.

9. A communication plug as claimed in claim 8 wherein said latching arm has a straight edged side portion on the opposite side of said centerline from said latching shoulder.

10. A communication plug as claimed in claim 9 wherein said straight edge of said side portion is spaced from said centerline a distance less than said latching shoulder to allow said edge to pass the latching stub in the jack frame on the same side of said centerline.

11. In a selectable compatibility electrical connector jack for compatibility with high and low performance connector plugs said jack having a jack frame having a centerline and a spring block having a stopped array of spring conductors, said jack frame comprising:

a hollow body portion having a front and rear portion;

a connector plug opening in said front portion and a spring block receiving opening in said rear portions; and a first latching stub in said front portion on one side of said centerline and a second latching stub on the other side of said centerline and longitudinally spaced toward said rear portion from said first latching stub.

12. The jack frame as claimed in claim 11 wherein said front portion of said jack frame has a portion having a front face extending therefrom and said first latching stub is flush with said front face.

13. The jack frame as claimed in claim 11 wherein said rear portion of said jack frame has a first plug stop member on one side of said centerline and extending toward said front portion a first distance and a second plug stop member on the other side of said centerline and extending toward said front portion a second distance less than said first distance.

14. The jack frame as claimed in claim 13 wherein said first plug stop member is on the same side of the centerline as said first latching plug.

15. The jack frame as claimed in claim 13 wherein said second plug stop is on the same side of said centerline as said second latching plug.

16. The jack frame as claimed in claim 11 wherein said rear portion has an upper projecting block extending toward said centerline, said block having a sloping bearing surface against which at least a portion of the spring contacts are adapted to rest.

17. The jack frame as claimed in claim 16 wherein said rear portion has a lower projecting block extending toward said upper projecting block, said lower block having an upper surface upon which are situated electrical circuit elements which are adapted to be contacted by displaced spring contracts.

18. The jack frame as claimed in claim 16 wherein said sloping bearing surface has electrical circuit elements thereon.

19. The jack frame as claimed in claim 18 wherein said rear portion has a lower projecting block extending toward said upper projecting block, said lower block having an upper surface upon which are situated electrical circuit elements.

20. The jack frame as claimed in claim 19 wherein at least some of said circuit elements are incorporated onto a printed wiring board.

21. The jack frame as claimed in claim 16 and further comprising:

a longitudinally extending bore in said upper projecting block;

a switching plunger movably mounted in said bore;

a circuit board having at least one circuit element thereon mounted on the rare portion of said jack frame and spaced from said switching plunger; and a spring contact member mounted on said circuit board and extending into the space between said switching plunger and said circuit element.

22. The jack frame as claimed in claim 21 wherein said switching plunger has a head on each end thereof and including a biasing spring between one of said heads and said upper projecting block to bias said plunger in a forward position.

23. The jack frame as claimed in claim 21 wherein said spring contact member bears against said switching plunger to bias said plunger in a forward position.

* * * * *